US008366105B1

(12) United States Patent
de Jong

(10) Patent No.: US 8,366,105 B1
(45) Date of Patent: Feb. 5, 2013

(54) MOTION QUALITY BY AUTOMATIC VELOCITY MATCH BETWEEN UPSTREAM AND DOWNSTREAM TRANSPORTS

(75) Inventor: Joannes N. M. de Jong, Hopewell Junction, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/337,373

(22) Filed: Dec. 27, 2011

(51) Int. Cl.
*B65H 5/00* (2006.01)

(52) U.S. Cl. ..... 271/264; 271/275; 271/198

(58) Field of Classification Search ..... 271/256, 271/258.01, 264, 265.01, 275, 69, 176, 198
See application file for complete search history.

(56) References Cited

U.S. PATENT DOCUMENTS 4,770,407 A * 9/1988 Nail ..... 271/275
6,435,498 B1 * 8/2002 Stefan et al. ..... 271/2

* cited by examiner

*Primary Examiner* — David H Bollinger
(74) *Attorney, Agent, or Firm* — Hoffmann & Baron, LLP

(57) ABSTRACT

A media transport includes first, second and third media transports to convey a substrate media. A force transducer outputs a force signal associated with a force between the first and second media transports. A sensor outputs a detection signal associated with substrate media being between the second and third media transports. A control unit outputs a first control signal to the first and/or second drive units, dependent upon a comparison of the force signal with a predetermined value. The first control signal commands the first or second drive unit to drive respective first or second media transports to maintain the force signal at or about no greater than the predetermined value. Responsive to the detection signal, the control unit outputs a second control signal in place of the first control signal, commanding the first and/or second drive unit at a predetermined speed.

31 Claims, 6 Drawing Sheets

MOTION QUALITY BY AUTOMATIC VELOCITY MATCH BETWEEN UPSTREAM AND DOWNSTREAM TRANSPORTS

BACKGROUND

1. Field of the Disclosure

The present disclosure relates to methods of document creation. More specifically, the present disclosure is directed to a system and method for substrate media handling in a marking station providing a high motion quality transfer of the substrate media from the marking zone to downstream handling apparatus.

2. Brief Discussion of Related Art

In direct-marking print applications, particularly those using stationary print heads, high motion quality of the substrate media, free from velocity disturbances or discontinuities, is necessary to achieve high quality image production. However, the transfer of the substrate media from the marking zone transport mechanism to a downstream transport mechanism can introduce disturbances to the motion quality, which can result in unwanted image artifacts on the document.

One potential solution is to introduce an intentional buckle in the substrate media during transport. In this way, any disturbances to motion quality can be absorbed by the buckle, with the flat portion of the substrate media generally undisturbed. Unfortunately, this technique is only applicable with lightweight media types, particularly those which can be buckled without causing permanent damage to the media substrate. This technique is not compatible with heavier and stiffer substrate media, including for example paperboard up to between about 26 and 29 point (i.e., about 0.026-0.029 in. thickness). Therefore, a solution compatible with many types of substrate media is desired.

SUMMARY

In order to overcome these and other weaknesses, drawbacks, and deficiencies in the known art, provided according to the present disclosure is a media transport apparatus for a printer, scanner or the like, or a printer or scanner having a media apparatus including a first media transport with a first transport surface and a first drive unit, configured and operative to convey a substrate media. A second media transport with a second transport surface and a second drive unit is configured and operative to receive the substrate media from the first media transport and to convey the substrate media. A third media transport having a third transport surface is configured and operative to receive the substrate media from the second media transport, and to convey the substrate media.

A first force transducer measures a first relative force between the first and second media transports, and outputs a first force signal associated with the first relative force. A sensor detects the presence of substrate media passing between the second media transport and third media transport, and outputs a second detection signal associated with the detection.

A control unit receives the first relative force signal and the second detection signal, and outputs a first control signal to at least one of the first and second drive units that is dependent upon a comparison of the first relative force signal with a predetermined value, the first control signal commanding the respective first or second drive unit to drive the motion of the respective first or second media transport to maintain the force signal at or about no greater than the predetermined value. The control unit further, responsive to the second detection signal, outputs a second control signal to at least one of the first and second drive units in place of the first control signal, commanding the respective first or second drive unit to drive the motion of the respective first or second media transport at a predetermined speed. A memory module may be included to store the predetermined speed value. The predetermined speed may be an average speed commanded by the first control signal over a predetermined period of time, for example and without limitation, a period of time without the second detection signal being output from the sensor.

As embodied in a printer, the printer includes a marking engine, or in more specific embodiments thereof, at least one of an ink jet marking engine, a xerographic marking engine, and a transfix marking engine.

In further embodiments, the first or second media transports may be mounted to a respective chassis body, and the first force transducer is mounted to interface with the chassis body or bodies. The first force transducer may be a load cell strain gauge, and may be particularly configured to measure a component of the first relative force generally aligned with a process direction of the first or second media transports.

The media transport apparatus herein disclosed may include first and/or second friction-reducing mounting supporting a second and third transport apparatus, respectively. The friction-reducing mounting provides at least one degree of freedom generally aligned with a process direction of the second transport apparatus.

In further embodiments, at least one of the first, second and third transports are operative to generate respective first, second or third hold down forces hold the substrate media to the respective first, second and third transport surfaces. The first, second or third hold down forces may be generated by an air pressure differential, an electrostatic field, or a combination thereof.

In certain embodiments of the media transport apparatus, at least one of the first or second media transports comprises a flexible belt routed over one or more rollers, the flexible belt being moved under the influence of the respective first or second drive units. The respective first or second media transport surfaces comprise surfaces of the flexible belt. In particular, in further embodiments the flexible belt is air-permeable, whereby a negative air-pressure introduced on a first side of the flexible belt induces a hold-down force on the substrate media carried on a second side of the flexible belt opposite the first side.

The sensor may include a plurality of sensors positioned transversely across the expected width of the substrate media or the width the second or third transports transverse to a process direction. The sensor may comprises one or a plurality of a photoelectric sensor, transmissive photoelectric sensor, diffuse reflective photoelectric sensor, ultrasonic sensor, capacitive proximity sensor, inductive proximity sensor, including combinations of the foregoing.

Further provided according to the instant disclosure is a media transport method including conveying a substrate media from a first media transport having a first transport surface and a first drive unit, to a second media transport having a second transport surface and a second drive unit, and measuring a first relative force between the first and second media transports, outputting a first force signal associated with the first relative force. The first force signal is received in a control unit, the control unit further outputting a control signal to at least one of the first and second drive units that is dependent upon a comparison of the first relative force signal with a predetermined value. The respective first or second drive unit receiving the control signal is commended to drive the motion of the respective first or second media, transport to maintain the force signal at or about no greater than the predetermined value. The substrate media is further conveyed from the second media transport to a third media transport having a third transport surface, and the presence of substrate media passing between the second media transport and third media transport is detected with a sensor. A second detection signal associated with the detection is output to the control unit. Responsive to the second detection signal, the control unit outputs a second control signal to at least one of the first and second drive units in place of the first control signal, the second control signal commanding the respective first or second drive unit to drive the motion of the respective first or second media transport at a predetermined speed.

In a more particular embodiment, the media transport method may include supporting the first second or third transport apparatus by a friction-reducing mount configured to provide at least one degree of freedom generally aligned with a process direction of the second or third transport apparatus. Further, optionally a respective first, second or third hold down force operative to hold the substrate media to respective first, second or third transport surfaces may be generated, for example and without limitation by an air pressure differential, an electrostatic field, or a combination thereof.

In still further embodiments, the method includes storing the predetermined speed value in a memory module. The predetermined speed is, optionally, an average speed commanded by the first control signal over a predetermined period of time, for example and without limitation a period of time without the second detection signal being output from the sensor.

In still further embodiments of the method disclosed, at least one of the first or second media transports provided include a flexible belt routed over one or more rollers, the flexible belt being moved under the influence of the respective first or second drive unit, and the respective first or second media transport surface comprises a surface of the flexible belt. Optionally, the flexible belt is air-permeable, whereby a negative air-pressure introduced on a first side of the flexible belt induces a hold-down force on the substrate media carried on a second side of the flexible belt opposite the first side.

The media transport method may further comprise positioning a plurality of sensors transverse to across the expected width of the substrate media or the width of the second or third transports transverse to a process direction.

These and other purposes, goals and advantages of the present application will become apparent from the following detailed description of example embodiments read in connection with the accompanying drawings.

BRIEF DESCRIPTION OF THE DRAWINGS

Some embodiments of the present disclosure are illustrated by way of example and not limitation in the figures of the accompanying drawings, in which like reference numerals refer to like structures across the several views, and wherein.

DETAILED DESCRIPTION

Introduction

As used herein, a "printer" refers to any device, machine, apparatus, and the like, for forming images on substrate media using ink, toner, and the like. A "printer" can encompass any apparatus, such as a copier, bookmaking machine, facsimile machine, multi-function machine, etc., which performs a print outputting function for any purpose. Where a monochrome printer is described, it will be appreciated that the disclosure can encompass a printing system that uses more than one color (e.g., red, blue, green, black, cyan, magenta, yellow, clear, etc.) ink or toner to form a multiple-color image on a substrate media.

As used herein, "substrate media" refers to a tangible medium, such as paper (e.g., a sheet of paper, a long web of paper, a ream of paper, etc.), transparencies, parchment, film, fabric, plastic, paperboard up to between about 26 and 29 point (i.e., about 0.026-0.029 in. thickness) or other substrates on which an image can be printed or disposed.

As used herein "process path" refers to a path traversed by a unit of substrate media through a printer to be printed upon by the printer on one or both sides of the substrate media. A unit of substrate media moving along the process path from away from its beginning and towards its end will be said to be moving in the "process direction".

As used herein, "transport" when used as a noun, "media transport" or "transport apparatus", each and all refer to a mechanical device operative to convey a substrate media through a printer to be marked with an image.

Description

Figure 1:
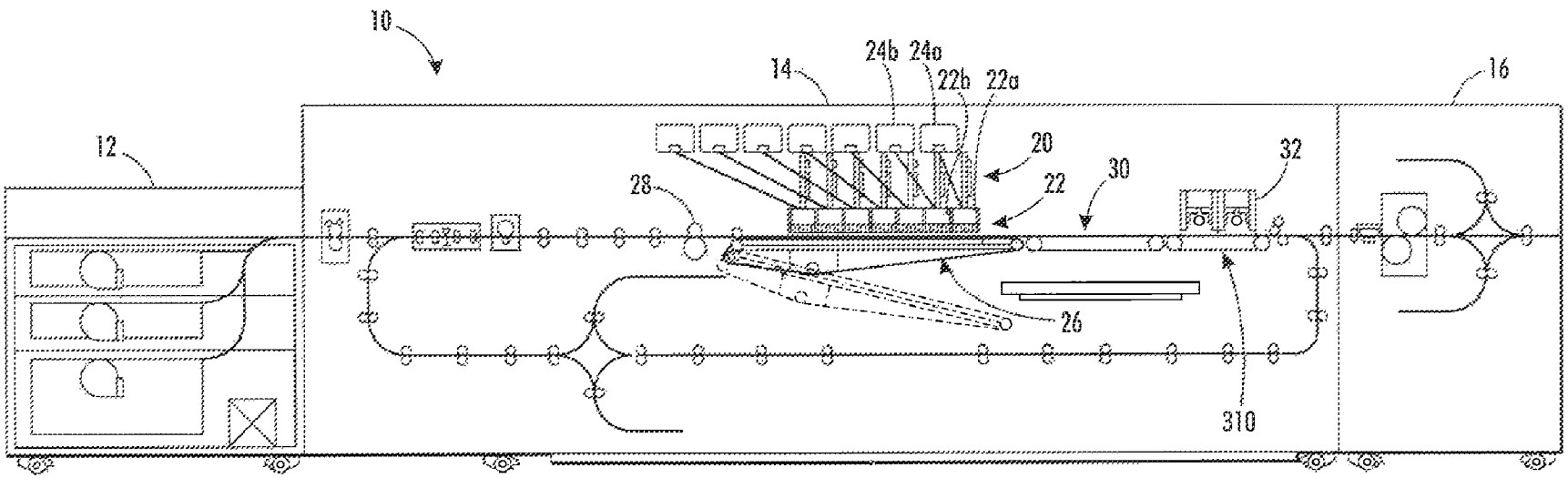
FIG. 1 illustrates a printer according to an exemplary embodiment of the present disclosure.

Referring now to FIG. 1, illustrated is a printer, generally 10, according to a first embodiment of the present disclosure. The printer 10 may include a media feeding unit 12 in which one or more types of substrate media may be stored and from which the substrate media may be fed, for example sheet-by-sheet feeding of a cut sheet medium, to be marked with an image. The media feeding unit 12 delivers substrate media to a marking unit 14. The marking unit delivers marked substrate media to an interface module 16 which may, for example, prepare the substrate for a finishing operation. Optionally the printer 10 may include a finishing unit (not shown), which receives printed documents from the interface module 16. The finishing unit, for example, finishes the documents by stacking, sorting, collating, stapling, hole-punching, or the like. While a printer is described as the exemplary apparatus, a media transport apparatus according to the present disclosure will be seen as applicable in any number of devices, including copiers, scanners or the like.

Marking unit 14 includes a marking zone, generally 20 within the marking unit 14. A marking zone 20 encompasses a marking engine, in this example an ink jet marking engine having one or more print heads 22*a*, 22*b*, etc., collectively print heads 22, any of which are operative to directly mark the substrate media and thereby form an image on the substrate media. One technology, as an example only, employable in a print head 22*a* is an ink jet print head configuration. The ink jet print head may draw ink from a reservoir 24*a*, 24*b*, etc. A marking zone transport 26 is operative to hold a substrate media to itself securely, for example by electrostatic means or vacuum means, without limitation. In other embodiments, the marking engine may comprise any technology for printmaking or document creation, including electrostatic (xerographic) transfer, or more colloquially laser-printing.

The marking zone transport 26 is further operative to receive a substrate media delivered towards the marking zone 20, for example by roller nips 28, and to convey the substrate media towards, into, through, out of and/or away from the marking zone 20, with positive control of the motion of the substrate media. The marking zone transport 26 maintains the substrate media within the marking zone 20 in sufficient proximity to the print heads 22 to permit them to mark the substrate media, but prevents the media from contacting the print heads.

The marking zone transport 26 is configured and operative to pass the substrate media to a downstream transport 30 for further handling. As example only, the downstream transport 30 would receive the substrate media from the marking zone transport 26 and deliver the substrate media to be subjected to a post-marking process 32, including without limitation ultraviolet light curing, fusing, spreading, drying, etc., any or some combination of which may be included without departing from the scope of the instant disclosure. The post-marking process 32 may of course be omitted, if desired.

In the embodiment of the present disclosure described herein, the substrate media transports 26, 30 between which motion is coordinated are both resident within the printing unit 14. However, it will be appreciated by those skilled in the art, in light of the present disclosure, that the disclosure may be implemented to pass substrate media between adjacent transports within or among any of the media feeding unit 12, the marking unit 14, or the handling unit 16, or substantially any other unit in which substrate media is transported, all without departing from the scope of Applicants' present disclosure.

Figure 2:
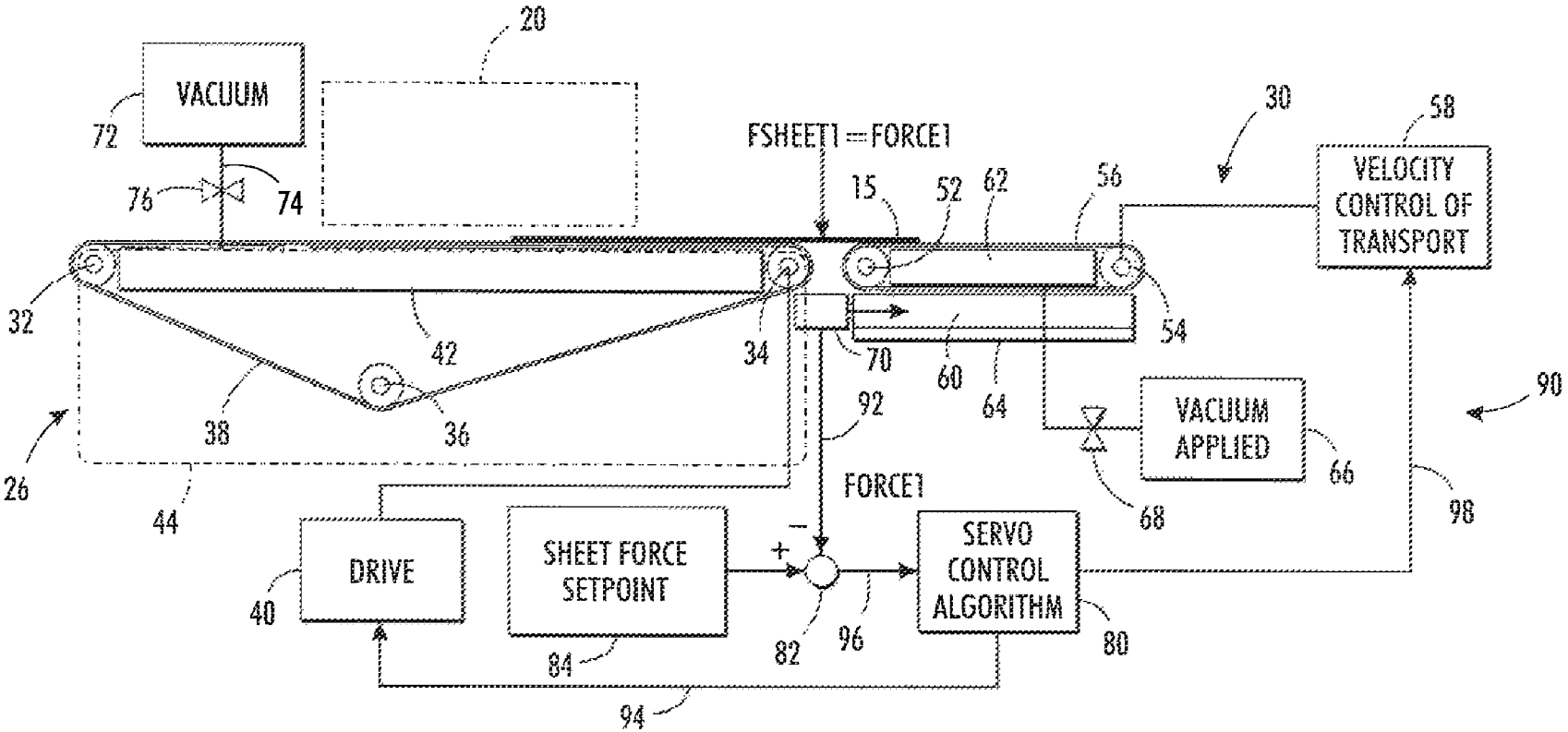
FIG. 2 illustrates schematically the motion control scheme for a substrate media.

Referring now to FIG. 2, illustrated schematically is the motion control scheme for substrate media passing between the marking zone transport 26, and the downstream transport 30. Marking zone transport 26 includes an endless belt 38 and a path around rollers 32, 34, and 36. In this case, roller 34 serves as a drive roller, roller 36 a tensioning roller, and roller 32 a steering roller. Other configurations will be seen as within the scope of the present disclosure to one skilled in the art. A marking zone transport drive unit 40 controls the motion of the drive roller 34 by commanding a motor (not shown) operatively connected with the drive roller 34. The endless belt 38 in certain embodiments is air-permeable, and a vacuum hold-down manifold 42 is positioned beneath the endless belt 38 where the endless belt 38 passed beneath the print heads 22, i.e., the endless belt lies at least in part between the vacuum hold-down manifold 42 and the print heads 22. The vacuum hold-down manifold 42 introduces a negative atmospheric pressure at its top surface, which in turn draws air through the air-permeable endless belt 34. A unit of substrate media lying on the endless belt 38 is drawn against it by the air flow which passes through the endless belt 38 and the vacuum hold-down manifold 42, and also by the air pressure differential between opposing sides of the substrate media 15. The vacuum hold-down manifold 42 is in fluid communication with a source of negative vacuum air pressure 72 via line 74. Flow through line 74 may be optionally controlled or varied, for example by provision of a flow control valve 76, pressure regulator, or the like. Alternately, vacuum source 72 may itself be configured to provide variable vacuum pressure. The print zone transport 26 is mounted by, on or to a frame or chassis portion 44 of the marking unit 14.

Further illustrated in FIG. 2 is a downstream transport 30, in the present example, downstream transport 30 also employs and endless belt 56 and a path around a plurality of rollers 52, 54, two in the case of the present example, though three or more, similar with print zone transport 26, may be optionally be employed. At least one roller, e.g., 54 of the downstream transport 30 is a drive roller, with others of the rollers, e.g., 52 being an idler(s) and/or steering roller. A downstream transport drive unit 58 controls the motion of the drive roller 54 by commanding a motor (not shown) operatively attached to drive roller 54. In the present example, endless belt 56 is also an air-permeable endless belt, and the downstream transport 30 is provided with a vacuum hold-down manifold 62 beneath at least a portion of the endless belt 56.

Furthermore, it will be appreciated that alternate hold-down means, for example an electrostatic hold-down system as known in the art, may be used in connection with the marking zone transport 26 and/or downstream transport 30 in addition to, or in place of the respective vacuum hold-down manifolds 42-62, without departing from the scope of the present disclosure.

The downstream transport 30 is mounted to or supported by a chassis frame 60. The chassis frame 60 is further optionally connected with the marking unit 14 via a friction-reducing slide 64, with at least one degree of freedom aligned with a processed direction that substrate media 15 moves through the printer 10. Optional slide 64 may be for example a linear slide, including a linear ball bearing slide, or may provide additional degrees of freedom, for example means for supporting chassis frame 60 on a fluid film, for example oil, which would give freedom of motion to the chassis frame 60 in both a process direction, and laterally with the processed direction.

The interface between the downstream transport chassis 60 and the frame or chassis 44 upon which the print zone transport 26 is mounted is monitored by a force transducer 70. Force transducer 70 may be a strain gauge, load cell, or other means for measuring and/or determining the force between downstream chassis 60 and print zone transport chassis 44. The downstream transport 60 will be isolated, including via optional slide 64, such that any relative force between the downstream transport 30 and print zone transport 26 will be detectable by force transducer 70.

In an alternative embodiment, downstream transport 30 is not mounted to a slide 64, but directly to a chassis 60. Chassis 60 may be in turn supported on the frame 44 in a way that the relative force between the two is determinable by force transducer 70. As example only, a pivotal connection may exist between frame 44 and chassis 60, combined with the force transducer at a second point of interface between the frame 44 and the chassis 60. Appropriate calculations would be made to account for the gravitational component of the forces between frame 44 and chassis 60.

In operation, it is desirable that there shall be no interruptions or disturbances to the motion quality of substrate media 15 as it passes adjacent the print zone 20 and from the print zone transport 26 to the downstream transport 30. One source of motion disturbances may be speed mismatch between the two transports. In that case, as the downstream transport exerts force upon the substrate media 15, the speed mismatch will be manifest as a force or tugging on the substrate media 15, ultimately culminating in disturbances to the motion quality, for example, constant speed nature of the motion, of the substrate media 15 through the print zone 20. As the force grows, the substrate media may slip which results in image distortion and/or undesirable artifacts.

Therefore, a control system, generally 90 is established using an output signal 92 front the source transducer 70 as feedback data. A sheet force set point 84 is established. Typically zero, though some level of force may be desirable, with a signal representing the sheet force set point delivered to a summing junction 82 together with the signal 92 from the force transducer 70. The output of the sum injunction 96 is transmitted to a controller 80, including a proportional-integral-derivative (PID) control algorithm for determining the velocity of one or both of the print zone transport 26 and downstream transport 30. The controller 80 outputs a control signal 98 which is directed towards drive unit 58 for control of the downstream transport drive roller 54. Alternately, or additionally, the controller 80 may transmit a signal 94 to print zone transport drive unit 40, for control of the print zone transport drive roller 34. In this way, the force feedback control maintains speed matching between the two transport units.

In related patent application Ser. No. 13/337,359, filed concurrently herewith, entitled IMPROVED MOTION QUALITY BY HANDOFF FORCE CONTROL BETWEEN UPSTREAM AND DOWNSTREAM TRANSPORTS, by inventors Johannes N. M. DeJong, Steven R. Moore and Peter J. Knausdorf, the complete disclosure of which is incorporated herein in its entirety for all purposes by this reference, the output of the force transducer 70 was used in part to control the velocity of the downstream transport 30. Further disclosed in the above-referenced patent application is a method and apparatus to address the effects of further downstream transports (i.e., ref 310, therein) on the interface between the downstream transport 30 and the print zone transport 26.

Figure 3:
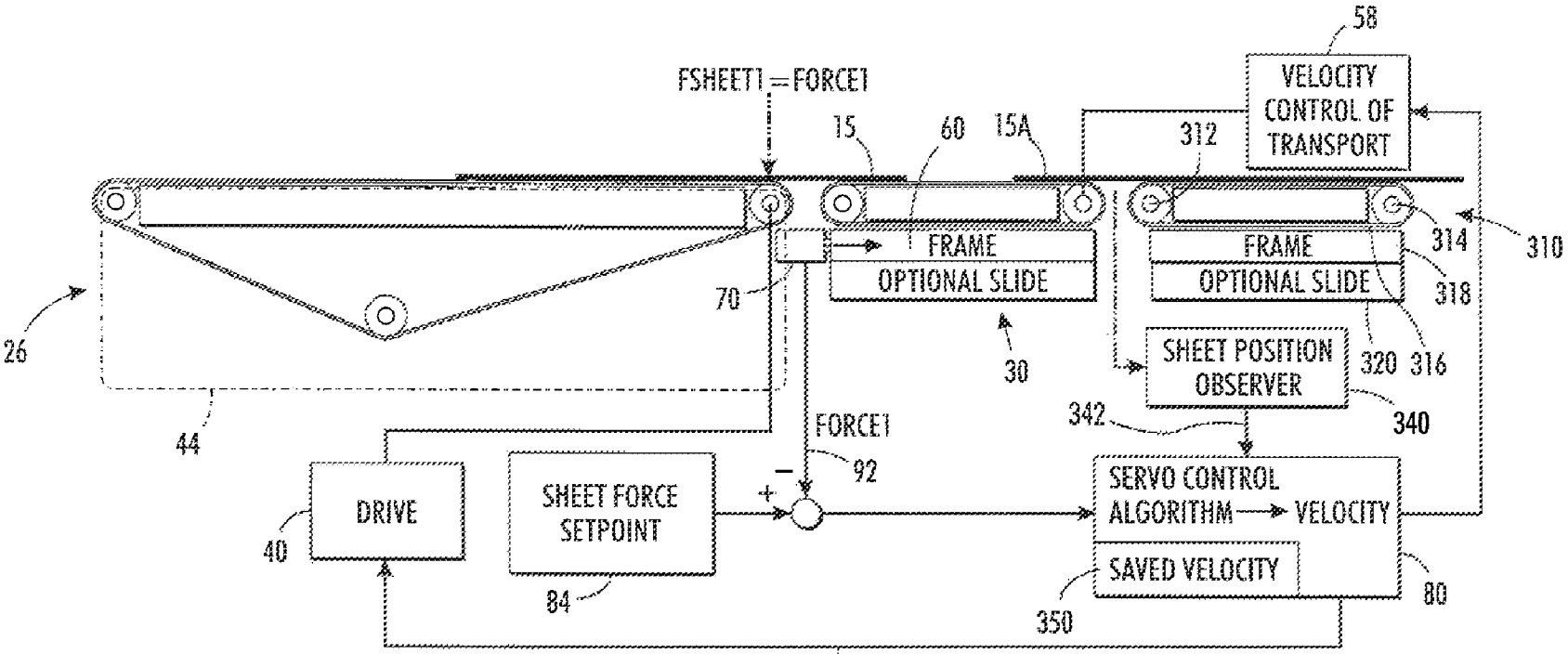
FIG. 3 illustrates an further embodiment of the motion control scheme for substrate media according to the present disclosure.

Referring now to FIG. 3, illustrated is an embodiment of the present disclosure, and in particular one having multiple sequential downstream transports, 30 and 310. For simplicity of discussion, downstream transport 310 is substantially analogous to downstream transport 30, for example having rollers 312, 314, at least one of which is a driven roller, the other being an idler and/or steering roller, and an endless belt 316 in a path around rollers 312, 314. The downstream transport 310 may optionally be mounted to and carried by chassis frame 318, which itself is optionally mounted to a slide 320 having at least one degree of freedom in the process direction. Alternately, downstream transport 310 may be mounted directly to downstream transport 30, or to the chassis 60.

It is contemplated according to the embodiment of FIG. 3 that, as a substrate media, e.g. 15*a*, bridges the gap between downstream transports 30 and 310, it may be subject to at hold-down force exerted by both downstream transports 30 and 310. Accordingly, any mismatch between the conveyance speed of downstream transports 310 and 30 may induce motion quality disturbances to the print zone transport 26, for example if there exists another substrate media 15 subject to the hold-down force of both the print zone transport 26 and the downstream transport 30. In the aforementioned related patent application, the problem of compound forces applied at the interface of print zone transport 26 and the downstream transport 30 are addressed including a second force transducer (FIG. 4, ref. 322 therein), as explained therein.

The present disclosure contemplates that the effect of the downstream transport 310 on either the print zone transport 26 or the intermediate downstream transport 30 only exist when a substrate 15*a* is subjected to a hold down force by both downstream transports 30 and 310. In such a condition, the substrate media 15*a* would bridge a gap 330 between downstream transports 30 and 310. A sensor 340 is provided to detect the presence of substrate media, e.g., 15*a*, over the gap 330. The sensor 340 may be one, or several distributed across the expected width of the substrate media 15*a* (including planned variations in media size), and/or the width of roller 54 or 312, transverse to the process direction. Among the sensors used may be photoelectric, transmissive, diffuse reflective, ultrasonic, capacitive or inductive proximity sensors, or the like, with further combinations of or variations on, these as will be apparent to those skilled in the art in light of the present disclosure. In alternate embodiments of the present disclosure, the presence of a substrate media 15*a* in a position to affect the motion quality of the print zone transport 26 may be inferred, for example by time and velocity of the plural media transports, To address the operation of the system where there is a substrate media 15*a* in position to be detected by the sensor 340, a sensor output signal 342 is input to the servo control algorithm 80. Upon detection of the substrate media 15*a* by the sensor 340, the corresponding signal 342 indicates to the servo control algorithm that the force signal 92 output from the force transducer 70 may be unreliable. In this case, the servo control algorithm 80 will refer to a saved velocity value stored in an associated memory module 350 associated with the servo control algorithm 80. This saved velocity can be derived from the first sheet in a print job, and may or may not be periodically updated. Using the saved velocity stored in memory module 350 when the signal 342 indicates a substrate media 15*a* across the gap 330 negates the effect of the downstream transport 310 on the motion quality of downstream transport 30 and/or print zone transport 26.

Figure 4A:
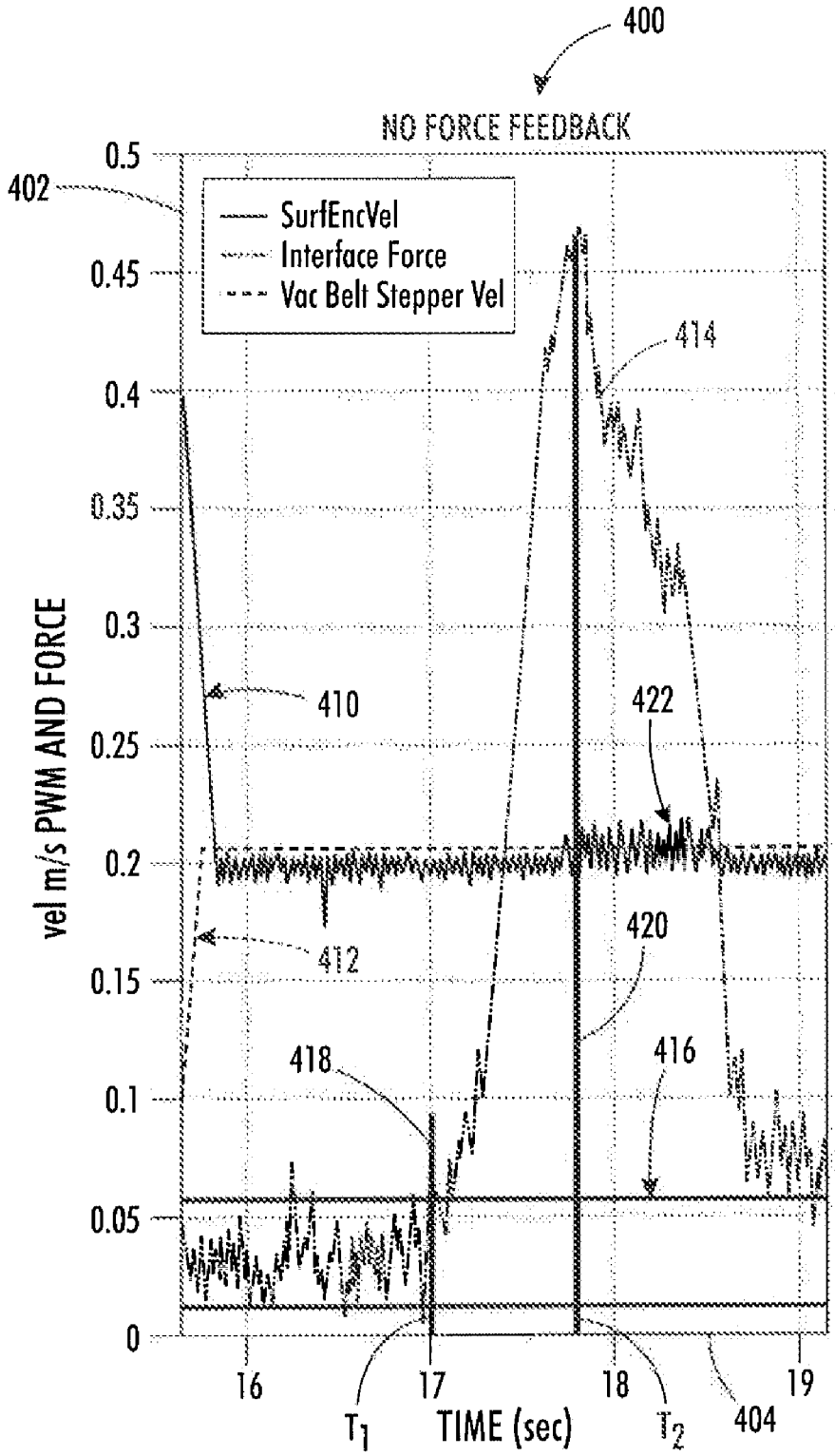
FIGS. 4A, 4B and 4C depict graph data derived from an experimental implementation of a system consistent with the present disclosure.
Figure 4B:
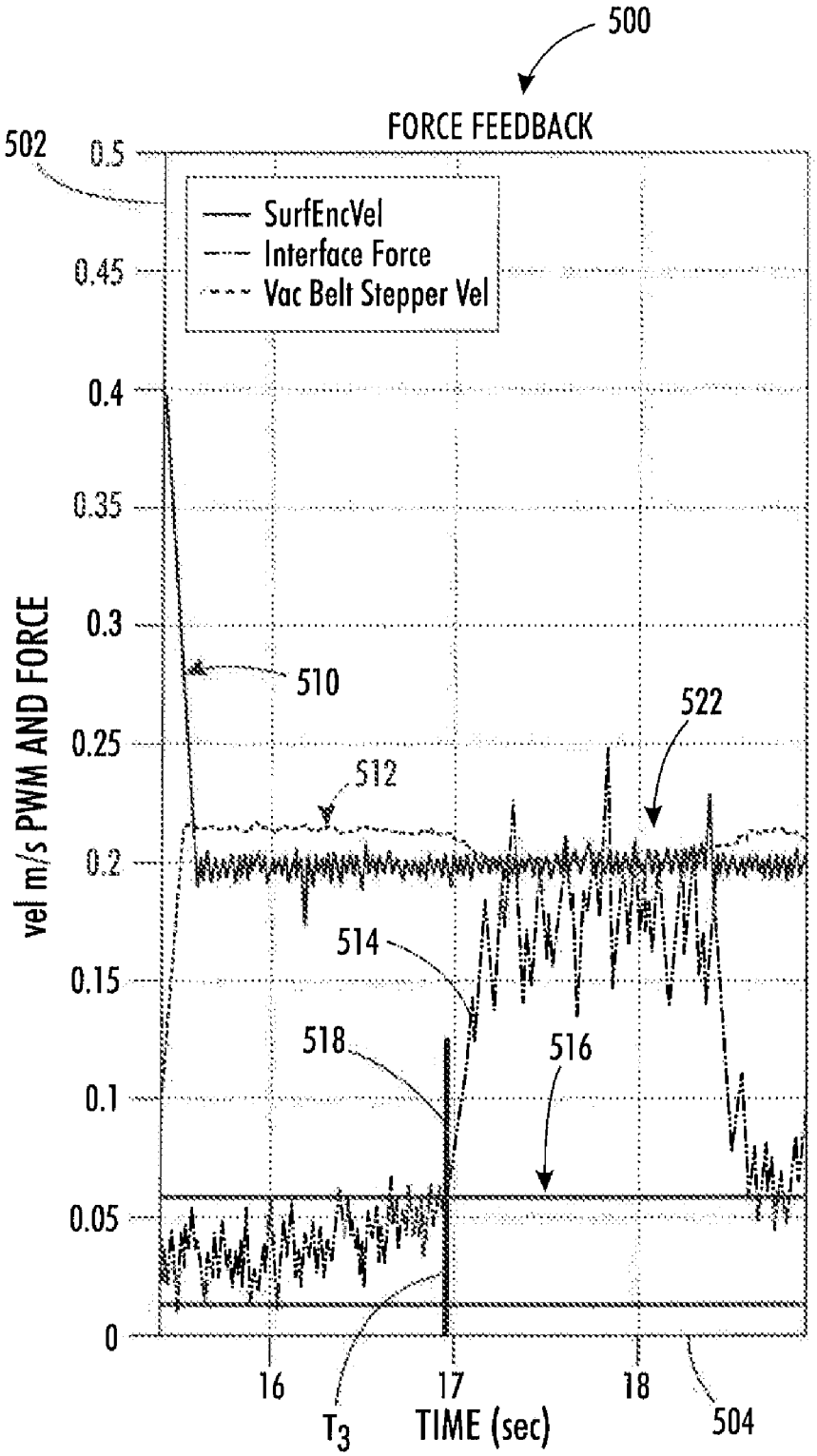
Figure 4C:
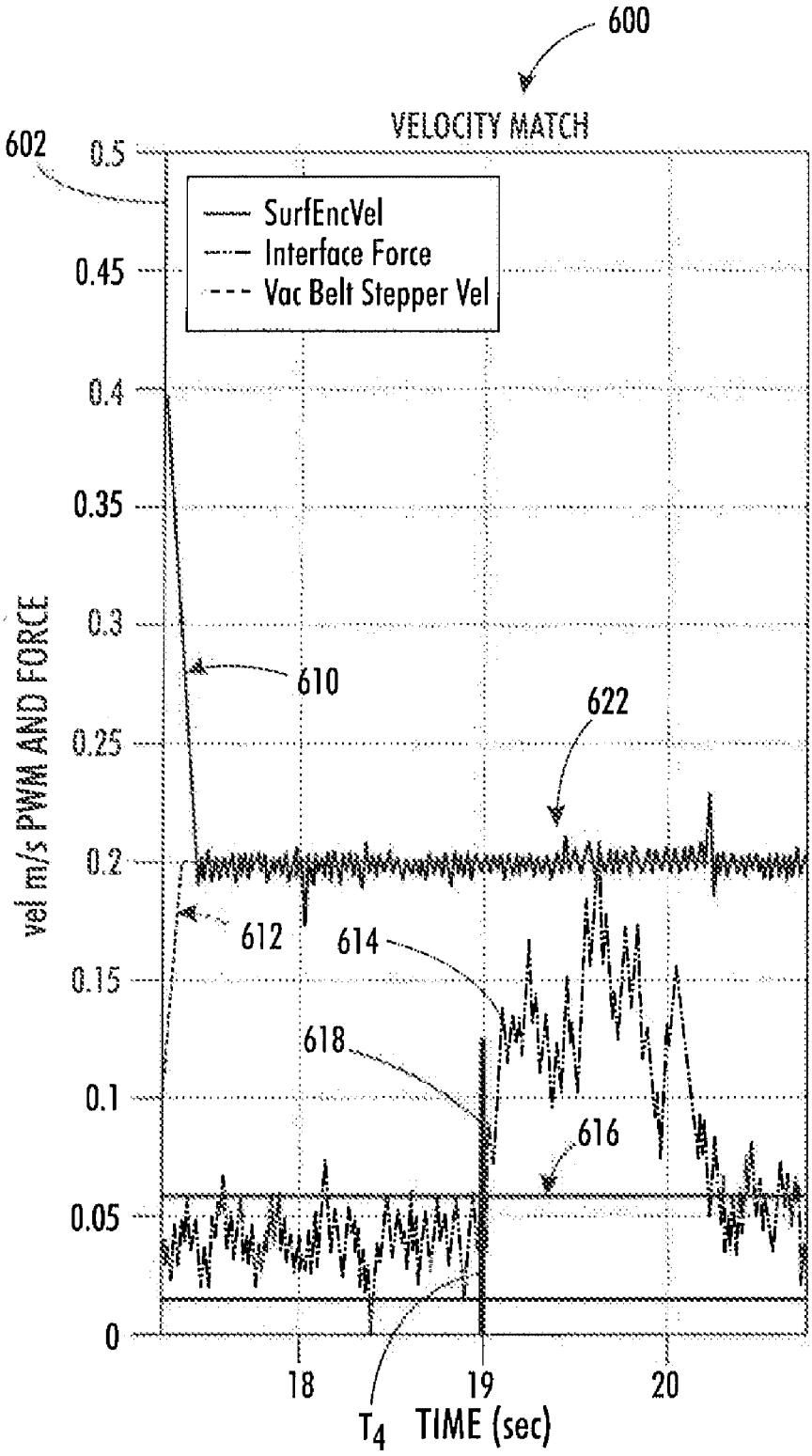

Referring now to FIGS. 4*a*, 4*b* and 4*c*, illustrated are data derived from an experimental implementation of a force feedback system generally according to the present disclosure. In FIG. 4*a*, graph 400 is defined by a vertical dependent axis 402 which measures alternately velocity in meters per second and force in Newtons, according to the data plot, as will be explained in further detail below. Independent horizontal axis 404 depicts time in seconds from a base line initiation of the print making process.

Line 410 of the graph 400 represents data derived from a rotary surface encoder indicating a surface velocity of the substrate media 15 in the print zone 20. Data line 112 indicates a stepper velocity of a stepper motor driving the vacuum belt of downstream transport 30. In this case, the stepper velocity 412 is controlled as constant. Data line 414 indicates an interface force between chassis frame 60 and frame 44 as measured by force transducer 70. As illustrated in the graph 400, the interface force 414 fluctuates generally within a nominal band 416 until the sheet media 15 bridges the gap between the transports 26, 30 indicated that time $T_1$, generally vertical line 418. From the time of interface, the interface force 414 grows sharply, reaching a peak at time $f_2$, indicated by vertical line 420. At our about the peak of interface force 414, disturbance in the surface velocity 410 of the substrate media 15 is indicated, generally at 422. The decrease in interface force 414 from its peak is a result of slippage in the substrate media, which slippage is manifest in the disturbances to motion quality at 122.

Referring then to FIG. 4*b*, illustrated is a graph, generally 500 having vertical dependent axis 502, and horizontal independent axis 504 that are analogous to there counterparts in graph 400 of FIG. 4*a*. Surface encoder velocity is indicated by data line 510, stepper velocity of the vacuum belt driver motor is indicated by data hoe 512, and interface force indicated by data line 514. Graph 500, and the experiment from which it is derived, differs from the prior example in that the vacuum belt stepper velocity 512 is not held constant at a presumed speed of the print zone transport 26. Rather, the vacuum belt stepper velocity 512 is controlled according to force feedback system illustrated at FIGS. 2 & 3. In this case, interface force 514 fluctuates within a nominal band 516, generally analogous to the prior graph 400. The substrate media 15 interfaces the downstream transport at time $T_3$ indicated by vertical line 518. In the example of FIG. 4*b* however, stepper velocity 512 is controlled by controller 80 in accordance with the force feedback or force transducer 70. As the interface force 514 rises, the stepper velocity 512 is allowed to decrease, to control the interface force 514 below the level seen in the prior example. As a result, and with reference generally to 522, the surface encoder velocity 510 remains substantially constant without the motion quality disturbances exhibited in the prior example, owing to the greatly reduced interface force 514.

Referring then to FIG. 4*e*, illustrated is a graph, generally 600 having vertical dependent axis 602, and horizontal independent axis 604 that are analogous to there counterparts in graphs 400 and 500 of FIGS. 4*a* and 4*b*, respectively. Surface encoder velocity is indicated by data line 610, stepper velocity of the vacuum belt driver motor is indicated by data line 612, and interface force indicated by data line 614. Graph 600, and the experiment from which it is derived, differs from the prior examples in that in this case, the vacuum belt stepper velocity 612 is set at the average velocity detected during the interface period 522 according to FIG. 4*b*. In this case, interface force 614 fluctuates within a nominal band 616, generally analogous to the prior graphs 400, 500. The substrate media 15 interfaces the downstream transport at time $T_4$ indicated by vertical line 618. In the example of FIG. 4*c*, and with reference generally to 622, the surface encoder velocity 610 remains substantially constant without the motion quality disturbances exhibited in the first example 400. It is therefore demonstrated that the use of the average velocity detected for example at 522 maintains good motion quality, and does not exhibit any excursions in interface force 612.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

I claim:

1. A media transport apparatus comprising:

a first media transport having a first transport surface and a first drive unit, the first media transport configured and operative to convey a substrate media;

a second media transport having a second transport surface and a second drive unit, the second media transport configured and operative to receive the substrate media from the first media transport and to convey the substrate media;

a third media transport having a third transport surface, the third media transport configured and operative to receive the substrate media from the second media transport, and to convey the substrate media;

a first force transducer operative to measure a first relative force between the first and second media transports, and to output a first force signal associated with the first relative force;

a sensor operative to detect the presence of substrate media passing between the second media transport and third media transport, and to output a second detection signal associated with the detection; and a control unit configured and operative to receive the first relative force signal and the second detection signal, and to output a first control signal to at least one of the first and second drive units that is dependent upon a comparison of the first relative force signal with a predetermined value, the first control signal commanding the respective first or second drive unit to drive the motion of the respective first or second media transport to maintain the force signal at or about no greater than the predetermined value, the control unit further configured and operative, responsive to the second detection signal, to output a second control signal to at least one of the first and second drive units in place of the first control signal, the second control signal commanding the respective first or second drive unit to drive the motion of the respective first or second media transport at a predetermined speed.

2. The media transport apparatus according to claim 1, further comprising a memory module operative to store the predetermined speed value.

3. The media transport apparatus according to claim 1, wherein the predetermined speed is an average speed commanded by the first control signal over a predetermined period of time.

4. The media transport apparatus according to claim 3, wherein the predetermined time includes a period of time when without the second detection signal being output from the sensor.

5. The media transport apparatus according to claim 1, wherein the at least one of the first and second media transports are mounted to a respective chassis body, and the first force transducer is mounted to interface with the chassis body.

6. The media transport apparatus according to claim 1, wherein the first force transducer comprises a load cell strain gauge.

7. The media transport apparatus according to claim 1, further comprising a first friction-reducing mounting supporting the second transport apparatus, configured to provide at least one degree of freedom generally aligned with a process direction of the second transport apparatus.

8. The media transport apparatus according to claim 1, wherein at least one of the first, second and third transports are operative to generate respective first, second or third hold down forces hold the substrate media to the respective first, second and third transport surfaces.

9. The media transport apparatus according to claim 8, wherein the first or second hold down forces are generated by an air pressure differential, an electrostatic field, or a combination thereof.

10. The media transport apparatus according to claim 1, wherein the first force transducer is operative to measure a component of the first relative force generally aligned with a process direction of the first or second media transports.

11. The media transport apparatus according to claim 1, further comprising a second friction-reducing mounting supporting the third media transport, configured to provide at least one degree of freedom generally in the process direction of the third media transport.

12. The media transport apparatus according to claim 1, wherein at least one of the first or second media transports comprises a flexible belt routed over one or more rollers, the flexible belt being moved under the influence of the respective first or second drive unit, and the respective first or second media transport surface comprises a surface of the flexible belt.

13. The media transport apparatus according to claim 12, wherein the flexible belt is air-permeable, whereby a negative air-pressure introduced on a first side of the flexible belt induces a hold-down force on the substrate media carried on a second side of the flexible belt opposite the first side.

14. The media transport apparatus according to claim 1, wherein the sensor comprises a plurality of sensors positioned transversely to a process direction of the media transport apparatus across the expected width of the substrate media or the width of the second or third transports.

15. The media transport apparatus according to claim 1, wherein the sensor comprises a photoelectric sensor, transmissive photoelectric sensor, diffuse reflective photoelectric sensor, ultrasonic sensor, capacitive proximity sensor, inductive proximity sensor, or a plurality having one or a combination of the foregoing sensors.

16. A printer comprising a marking engine operative to mark an image on a substrate media;

a first media transport having a first transport surface and a first drive unit, the first media transport configured and operative to convey a substrate media;

a second media transport having a second transport surface and a second drive unit, the second media transport configured and operative to receive the substrate media from the first media transport and to convey the substrate media;

a third media transport having a third transport surface, the third media transport configured and operative to receive the substrate media from the second media transport, and to convey the substrate media;

a first force transducer operative to measure a first relative force between the first and second media transports, and to output a first force signal associated with the first relative force;

a sensor operative to detect the presence of substrate media passing between the second media transport and third media transport, and to output a second detection signal associated with the detection; and a control unit configured and operative to receive the first relative force signal and the second detection signal, and to output a first control signal to at least one of the first and second drive units that is dependent upon a comparison of the first relative force signal with a predetermined value, the first control signal commanding the respective first or second drive unit to drive the motion of the respective first or second media transport to maintain the force signal at or about no greater than the predetermined value, the control unit further configured and operative, responsive to the second detection signal, to output a second control signal to at least one of the first and second drive units in place of the first control signal, the second control signal commanding the respective first or second drive unit to drive the motion of the respective first or second media transport at a predetermined speed.

17. The printer according to claim 16, wherein the marking engine comprises at least one of an ink jet marking engine, a xerographic marking engine, and a transfix marking engine.

18. The printer according to claim 16, wherein at least one of the first or second media transports comprises a flexible belt routed over one or more rollers, the flexible belt being moved under the influence of the respective first or second drive unit, and the respective first or second media transport surface comprises a surface of the flexible belt.

19. The printer according to claim 18, wherein the flexible belt is air-permeable, whereby a negative air-pressure introduced on a first side of the flexible belt induces a hold-down force on the substrate media carried on a second side of the flexible belt opposite the first side.

20. A media transport method comprising:

conveying a substrate media from a first media transport having a first transport surface and a first drive unit, to a second media transport having a second transport surface and a second drive unit;

measuring a first relative force between the first and second media transports, and outputting a first force signal associated with the first relative force;

receiving the first force signal in a control unit, the control unit further outputting a control signal to at least one of the first and second drive units that is dependent upon a comparison of the first relative force signal with a predetermined value;

commanding the respective first or second drive unit receiving the control signal to drive the motion of the respective first or second media transport to maintain the force signal at or about no greater than the predetermined value conveying the substrate media from the second media transport to a third media transport having a third transport surface;

detecting the presence of substrate media passing between the second media transport and third media transport with a sensor, and outputting a second detection signal associated with the detection to the control unit; and responsive to the second detection signal, outputting from the control unit a second control signal to at least one of the first and second drive units in place of the first control signal, the second control signal commanding the respective first or second drive unit to drive the motion of the respective first or second media transport at a predetermined speed.

21. The media transport method according to claim 20, further comprising:

mounting at least one of the first and second media transports to a chassis body; and mounting the first force transducer is to interface with the chassis body.

22. The media transport method according to claim 20, further comprising:

supporting the second transport apparatus by a friction-reducing mount configured to provide at least one degree of freedom generally aligned with a process direction of the second transport apparatus.

23. The media transport method according to claim 20, further comprising:

generating a respective first, second or third hold down force operative to hold the substrate media to respective first, second or third transport surfaces.

24. The media transport method according to claim 23, wherein the first, second or third hold down forces are generated by an air pressure differential, an electrostatic field, or a combination thereof.

25. The media transport method according to claim 20, further comprising:

measuring a component of the first relative force generally aligned with a process direction of the first or second media transports with the first force transducer.

26. The media transport method according to claim 20, further comprising:

storing the predetermined speed value in a memory module.

27. The media transport method according to claim 20, wherein the predetermined speed is an average speed commanded by the first control signal over a predetermined period of time.

28. The media transport apparatus according to claim 27, wherein the predetermined time includes a period of time when without the second detection signal being output from the sensor.

29. The media transport method according to claim 20, wherein at least one of the first or second media transports comprises a flexible belt routed over one or more rollers, the flexible belt being moved under the influence of the respective first or second drive unit, and the respective first or second media transport surface comprises a surface of the flexible belt.

30. The media transport method according to claim 29, wherein the flexible belt is air-permeable, whereby a negative air-pressure introduced on a first side of the flexible belt induces a hold-down force on the substrate media carried on a second side of the flexible belt opposite the first side.

31. The media transport method according to claim 20, further comprising positioning a plurality of sensors transversely to a process direction of the transport apparatus across the expected width of the substrate media or the width of the second or third transports.

* * * * *